United States Patent [19]

Guigley

[11] 4,373,215

[45] Feb. 15, 1983

[54] DOUBLE SOCK CONSTRUCTION

[75] Inventor: Paul A. Guigley, Mohnton, Pa.

[73] Assignee: Wm. G. Leininger Knitting Company, Mohnton, Pa.

[21] Appl. No.: 160,966

[22] Filed: Jun. 19, 1980

[51] Int. Cl.[3] ..... A41B 11/00

[52] U.S. Cl. ..... 2/239

[58] Field of Search ..... 2/239, 240, 241; 66/178

[56] References Cited

U.S. PATENT DOCUMENTS

| | | | |
|---|---|---|---|
| 294,020 | 2/1884 | Eisendrath | 2/239 X |
| 2,263,763 | 11/1941 | Edwards | 66/178 |
| 2,433,834 | 1/1948 | Bazett et al. | 2/239 X |
| 2,663,877 | 12/1953 | Bohman | 2/239 |
| 2,814,807 | 12/1957 | Dollar | 2/239 |
| 3,259,915 | 7/1966 | Dison | 2/239 |
| 3,510,882 | 5/1970 | White | 2/239 |
| 3,796,067 | 3/1974 | East | 66/178 |
| 4,038,699 | 8/1977 | Burn | 2/239 |
| 4,255,949 | 3/1981 | Thorneberg | 2/239 X |
| 4,282,728 | 8/1981 | Tapp et al. | 2/239 X |

*Primary Examiner*—H. Hampton Hunter

*Attorney, Agent, or Firm*—Synnestvedt & Lechner

[57] ABSTRACT

A double sock construction comprising inner and outer tubular socks each terminating at one end in a closed toe portion of reduced thickness. The inner and outer socks are joined at their ends opposite their toe portions to form a fold line. The inner sock is shorter than the outer sock, which feature coupled with the reduced thickness of the toe portions, prevents bunching of the toe of the double sock.

5 Claims, 4 Drawing Figures

DOUBLE SOCK CONSTRUCTION

BACKGROUND OF THE INVENTION

The present invention relates generally to socks for outdoor cold-weather wear and relates more particularly to a novel double sock construction.

It is a fairly common practice among those who spend time outdoors in cold weather to wear two pairs of socks under insulated boots. Those who engage in hunting, hiking, skiing, snowmobiling, etc. have long appreciated the advantages of wearing a relatively thin soft inner sock in engagement with the foot, and a thick outer sock to provide insulating bulk and a comfortable cushioning of the foot.

Although the practice of wearing two pairs of socks is relatively widespread, it is an inconvenient practice due to the need to provide two pairs of socks which together provide a compatible and comfortable fit with respect to a particular pair of boots. There is accordingly much trial and error in selecting appropriate inner and outer socks to accomplish this purpose. Generally, the outer sock should be a larger size than the inner sock but in some instances, the next larger size may prove too large to be accommodated within the shoe or boot space. There is additionally the problem of obtaining socks of suitable materials both as to thickness, comfort, durability and absorbency. Finally, there is a tendency for the inner sock to work downwardly with respect to the outer sock, and to work its way into an unreachable condition, requiring the removal of the boot and both pairs of socks in order to be correctly repositioned. This can be time consuming, annoying, and, under frigid conditions, dangerous as it permits exposure of uncovered skin to freezing conditions.

Suggestions have, in the past, been made for the combining of two pairs of socks into a double sock. Difficulties were encountered, however, in aligning the inner sock with the outer sock so that the heel portions of each were proximate the heel of the wearer. Attempts to sew both the toe and the ankle portions of the inner and outer socks together did not wholly alleviate this problem and furthermore made washing of the double socks difficult. Furthermore, foreign matter could be trapped between the two sock layers and removal could be difficult.

A further difficulty with previous double sock constructions as well as with the wearing of two separate pairs of socks together has been the discomfort experienced due to the bunching of the sock toe portions. Such bunching is normally associated with a sliding movement of one sock with respect to the other and with respect to the foot. One of the socks or sock portions, and normally the inner one, drifts downwardly resulting in discomfort in the toe region as well as a loss of the insulating and cushioning function of the sock in the region from which it has descended.

BRIEF SUMMARY OF THE INVENTION

The present invention comprises a double sock construction including inner and outer tubular socks which are joined at their upper ends along a fold line. The inner sock is shorter than the outer sock in length and the toe portions of both the inner and outer socks are of reduced thickness. Both the inner and outer socks are preferably knit with some stretch yarns to provide length-wise stretch of the socks. The inner sock may be withdrawn from the outer sock by turning it inside out to facilitate washing or the removal of foreign matter. The inner sock is preferably knit of a soft absorbent yarn such as cotton to provide a comfortable surface in engagement with the foot, while the outer sock may be knit of a bulkier yarn such as wool having good insulating and cushioning properties.

It is accordingly a first object of the present invention to provide a double sock construction which is comfortable to wear and which may be readily put on and removed.

It is a further object of the invention to provide a double sock construction as described wherein the inner sock may be easily withdrawn from the outer sock to facilitate washing or removal of foreign matter.

Still another object of the invention is to provide a double sock construction as described which by utilizing stretch yarns need be made in only a few sizes which will accommodate a wide range of foot sizes.

A still further object of the invention is to provide a double sock construction as described which will have the appearance of a single sock.

Another object of the invention is to provide a double sock construction as described wherein the inner and outer socks are secured against relative downward movement.

A still further object of the invention is to provide a double sock construction as described which is adapted to manufacture on automatic knitting machines.

Additional objects and advantages of the invention will be more readily apparent from the following detailed description of an embodiment thereof.

DESCRIPTION OF THE PREFERRED EMBODIMENT

Figures 1, 2, 3, 4:
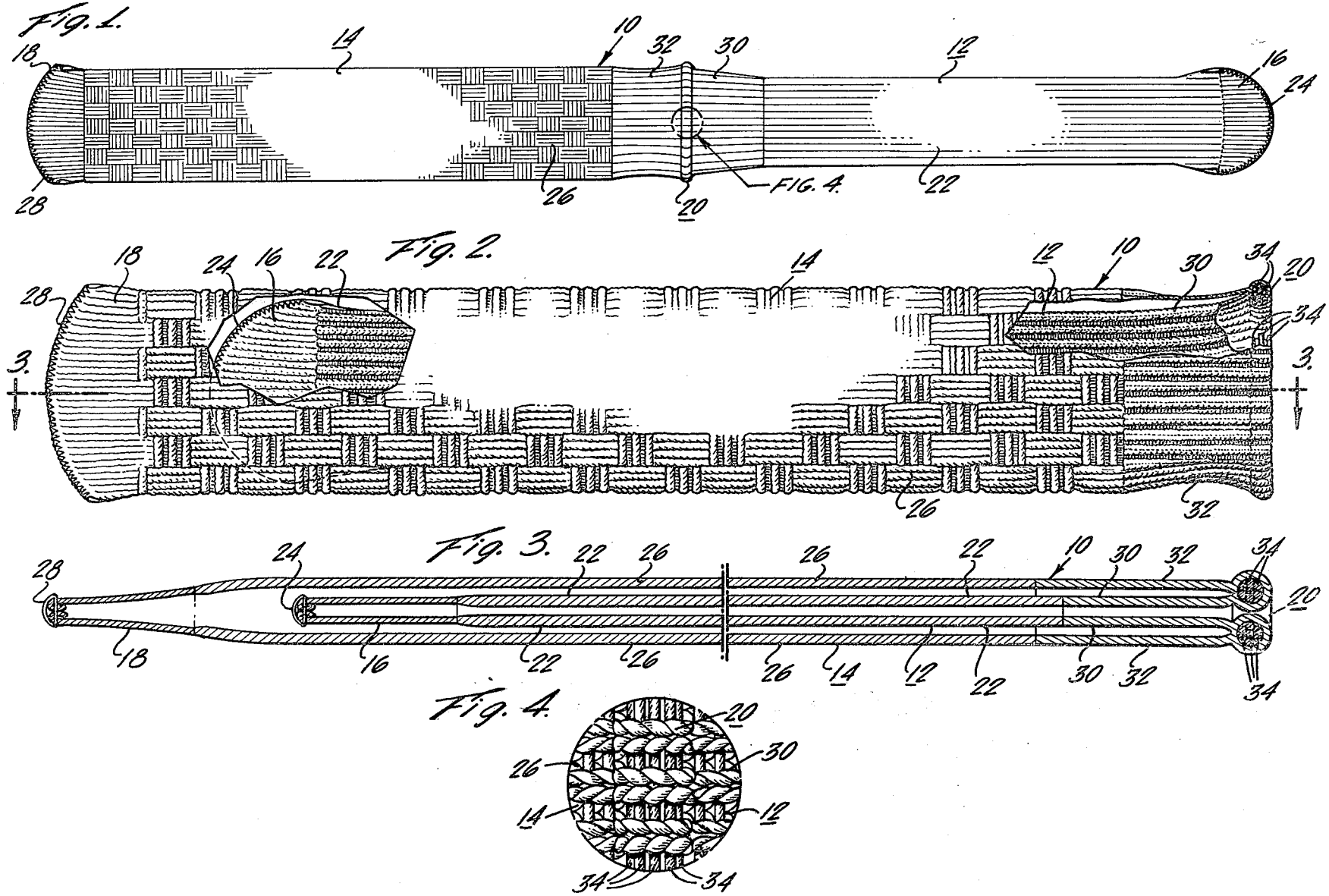
FIG. 1 is a plan view of a double sock construction in accordance with the present invention with the inner sock thereof turned inside out and with the inner and outer socks laid out longitudinally.
FIG. 2 is an enlarged view of the double sock construction of FIG. 1 showing the inner side in its normal position within the outer sock and with portions of the outer sock broken away to show details of the inner sock.
FIG. 3 is an enlarged interrupted side elevational view of the double sock construction of FIGS. 1 and 2.
FIG. 4 is an enlarged view of the circled portion of FIG. 1 showing the knitting construction of the fold line joining the inner and outer socks.

Referring to the drawings, a double sock generally designated 10 in accordance with the present invention comprises an inner sock 12 and an outer sock 14. Both the inner and outer socks are of a tubular knit construction. One end of the inner sock 12 is sewn closed to form a toe portion 16 and, similarly, one end of the outer sock 14 is sewn closed to form a toe portion 18. The inner and outer socks are circumferentially joined along their respective ends opposite the toe portions 16 and 18 in a manner forming a fold line 20 which establishes the upper end of the double sock. The inner and outer socks are joined only at the fold line 20 and the inner sock may accordingly be withdrawn from the outer sock as illustrated in FIG. 1 by turning the inner sock inside out. This is the preferred disposition of the sock for washing and also permits the removal of foreign matter which may have found its way into the inner sock.

As shown in FIGS. 2 and 3, the inner sock in its relaxed state is somewhat shorter in length than the outer sock, a feature of considerable importance in providing a comfortable fit of the double sock. In addition, the toe portions 16 and 18 of the inner and outer sock are each of a reduced thickness with respect to the body of the socks as shown in FIG. 3.

The inner and outer socks are preferably knitted of different materials best suited to carry out their respective functions. The inner sock is preferably knitted predominently of cotton yarn with some stretch nylon added to produce the desired amount of resilience particularly in the lengthwise direction. In the embodiment illustrated, the body portion 22 of the inner sock is of a rib knit structure and accordingly provides a relatively smooth, soft and absorbent surface in engagement with the wearer's foot. The inner sock toe portion 16 should preferably be formed predominently of a fine count cotton yarn to provide a flat fabric having substantially less thickness than that of the body portion 22. The toe portion 16 is sewn closed to form an arcuate end seam 24.

The body portion 26 of the outer sock 14 is in the illustrated embodiment knitted in a basket weave construction of predominently wool yarn to provide a relatively thick insulating and cushioning outer layer. A certain degree of stretchability in the longitudinal direction is achieved by adding elastic yarn such as stretch nylon in an amount which will substantially equalize the stretchability of the inner and outer socks. The toe portion 18 of the outer sock 14 is, in a manner similar to that of the inner sock toe portion, formed of a finer yarn to produce a flat and thinner fabric. The closed end of the toe portion 18 is formed by sewing a closing seam 28 in an arcuate path which in the flattened condition of the double sock lies in the same plane as the seam 24 of the inner sock toe portion. The arcuate shape of the respective inner and outer sock toe portions need not be identical but should be compatible to conform with the wearer's foot.

The upper ends of the inner and outer socks respectively terminate in rib knit cuff portions 30 and 32 which desirably contain a higher percentage of elastic yarns to hold the upper end of the double sock in place on the wearer's leg. The open ends of the cuff portions 30 and 32 are joined at the fold line 20 which as illustrated in FIGS. 3 and 4 includes a number of transverse elastic yarns 34 which are knitted circumferentially to define the fold line. The knitting of the fold line or welt at the upper end of the double sock provides a smoothly finished sock edge having the appearance of a single pair of socks. Furthermore, the knitted edge construction permits an accurate control of the length of the inner and outer socks and a strong and long-wearing connection of the inner and outer portions. This construction is adapted for manufacture on automatic knitting equipment in a continuous operation with only the cutting and sewing of the toe closures being required to complete the double socks.

Although it might be feasible to form the upper edge of the double sock by sewing the inner and outer sock upper ends together, the sewn joint would not be as attractive in appearance nor would it permit as accurate a control of the relative lengths of the inner and outer socks.

For application to a wearer's foot, the socks are disposed in the condition shown in FIGS. 2 and 3 with the inner sock disposed within the outer sock and the respective toe portions in parallel alignment. The foot is then inserted into both socks simultaneously with the toes substantially in the same plane as the toe portions of the inner and outer socks to achieve the most comfortable fit. In view of the shorter relaxed dimension of the inner sock, the inner sock will conform closely to the wearer's foot whereas the outer sock will conform in a somewhat looser manner and fill the available toe space in the boot or shoe.

The shorter length of the inner sock as well as the reduced thickness of the toe portions of both the inner and outer socks combine to prevent bunching of sock material in the toe region which is a primary cause of discomfort when wearing two pairs of socks or double socks of other constructions. Although the relative lengths of the inner and outer socks may vary depending upon the overall sock length, the materials used in the respective sock portions and the knitting construction, in the embodiment illustrated which depicts a boot length sock, the inner sock is approximately 10% shorter than the outer sock. As indicated, this percentage could change depending upon the construction of the socks and on the amount of elastic yarn utilized in the inner and outer socks.

Manifestly, changes in details of construction can be effected by those skilled in the art without departing from the spirit and scope of the present invention.

I claim:

1. A double sock comprising an integral knit structure comprising an inner sock and an outer sock circumferentially joined at their respective ends, said inner sock having a tubular body portion, a closed toe portion at the free end of said inner sock body portion, said toe portion being of a reduced thickness with respect to said body portion, an outer sock having a tubular body portion of larger diameter than said inner sock body portion, a toe portion at the free end of said outer sock body portion, said outer sock toe portion being of a reduced thickness with respect to said outer sock body portion, the juncture of said inner and outer socks comprising a knitting structure forming a welt to establish a circumferential fold line at the upper end of said double sock, said inner sock being substantially shorter in length than said outer sock, the knitting structure of said inner and outer socks including stretch yarns which permit a resilient conformance thereof with the foot of a wearer.

2. The invention as claimed in claim 1 wherein said inner and outer socks are comprised predominently of different materials.

3. The invention as claimed in claim 1 wherein said inner sock is comprised predominently of cotton yarn and wherein said outer sock is comprised predominently of wool yarn.

4. The invention as claimed in claim 1 wherein said inner and outer socks each include a cuff portion adjacent said welt.

5. The invention as claimed in claim 4 wherein said cuff portion includes added elastic yarn.

* * * * *